US007124697B2

(12) United States Patent
Foley

(10) Patent No.: US 7,124,697 B2
(45) Date of Patent: Oct. 24, 2006

(54) APPARATUS FOR MONITORING AND CONTROLLING THREAD TENSIONING FORCE IN A SEWING MACHINE

(76) Inventor: Martin J. Foley, 1034 Roslyn Rd., Grosse Pointe Woods, MI (US) 48236

( * ) Notice: Subject to any disclaimer, the term of this patent is extended or adjusted under 35 U.S.C. 154(b) by 94 days.

(21) Appl. No.: 10/625,273

(22) Filed: Jul. 23, 2003

(65) Prior Publication Data
US 2004/0103834 A1 Jun. 3, 2004

Related U.S. Application Data

(60) Provisional application No. 60/400,724, filed on Aug. 2, 2002.

(51) Int. Cl.
*D05B 47/04* (2006.01)

(52) U.S. Cl. ..... 112/255

(58) Field of Classification Search ..... 112/470.01, 112/254, 255, 278; 73/159, 160, 862.474, 73/862.473, 862.471, 862.381, 862.391, 73/862.42; 242/148, 149, 150 R, 419.3, 242/419.4, 417.1, 331.3
See application file for complete search history.

(56) References Cited

U.S. PATENT DOCUMENTS 4,884,763 A * 12/1989 Rydborn ..... 242/148
5,033,400 A * 7/1991 Fischer ..... 112/254
6,595,150 B1 * 7/2003 Yamazaki ..... 112/470.05

* cited by examiner

*Primary Examiner*—Danny Worrell
(74) *Attorney, Agent, or Firm*—The Weintraub Group, PLC

(57) ABSTRACT

A thread tensioning device or apparatus for a sewing machine enables accurate, repeatable measurement and monitoring of the compression forces applied to the thread tensioning discs thereof. The apparatus further includes a visual display or output corresponding to the actual amount of compressive force being applied. The device further includes a comparator, which compares the electrical signal to a predetermined reference value to control or regulate the normal operation of the sewing machine.

8 Claims, 5 Drawing Sheets

APPARATUS FOR MONITORING AND CONTROLLING THREAD TENSIONING FORCE IN A SEWING MACHINE

CROSS-REFERENCE TO RELATED APPLICATIONS

This application is a completion application of co-pending U.S. Provisional Patent Application Ser. No. 60/400,724, filed Aug. 2, 2002, the disclosure of which is hereby incorporated by reference.

BACKGROUND OF THE INVENTION

1. Field of the Invention

The following invention relates to sewing machines, and more particularly, to automatic apparatus for monitoring and controlling thread tensioning force in a sewing machine.

2. Description of Prior Art

An existing sewing machine routes the sewing thread through a tensioning apparatus and the thread tension is manually adjusted by an operator, in part, by means of a pair of discs that are compressed against the thread. The correct tension results in a stitch that looks identical on both sides of the material. That is, the knots of the stitches are pulled into the fabric and are no more visible on the top than on the bottom.

To tighten the thread feeding into the needle, a thread-tensioning knob on the front of the machine is turned through a range of about five revolutions to compress a spring that squeezes the two discs together. Generally, the tension must be looser when sewing thinner fabric and tighter when sewing thicker fabric. Further, thread type can affect tension. If the sewer is using rayon thread, the tension will have to be a little looser because the tensile strength of rayon is not the same as that of polyester. Polyester can stand a tighter tension and needs a tighter tension to avoid looping.

Proper tension adjustment will eliminate problems associated with loose threads, looping, puckering, bunching, and other like problems. The problems associated with proper thread tensioning are described in U.S. Pat. No. 6,152,057, "Bobbin Assembly Incorporating a Thread Tensioning Assembly and Method of Controlling the Payout of Thread From a Bobbin Assembly", issuing Nov. 28, 2000 to Badillo, the Specification hereby incorporated by reference.

However, thread tensioning apparatus of the typical sewing machine does not provide any means of monitoring or measuring the compression force applied to the discs or the comparing of the thread tensioning force to a predetermined reference to assure that the proper thread tension is applied to the sewing thread.

There have been many proposals for automating the above-mentioned regulation of proper thread tension. However, practical and useful proposals have not been realized.

SUMMARY OF THE INVENTION

A primary objective of this invention is provision of a thread tensioning apparatus for a sewing machine that provides the operator with accurate, repeatable measurement and monitoring of a compression force applied to the thread tensioning discs of the thread tensioning apparatus.

A further objective of this invention is the provision of thread tensioning apparatus that provides a visual display, or output, corresponding to the actual amount of compressive force being applied.

Still another objective of this invention is the provision of a method of control that allows, or disallows, normal operation of the sewing machine, based on electronic comparison of the electrical signal to predetermined reference values. Desirably, the comparison is performed by the electronic control.

According to this invention, there is provided in a sewing machine a thread tension adjusting apparatus for adjusting and monitoring the tension of a supplied thread by adjusting a thread holding force, the apparatus being positioned on a thread supply path running from a thread source to a thread processing station, said thread tension adjusting apparatus comprising:

a pair of clamping members movably mounted in juxtaposition with one another and the thread when passing from the source to the station, the clamping members being movable towards one another and into clamping relation with the thread passing therebetween, an electromechanical compression load cell disposed in contacting relation against one of said clamping members, said load cell being separate and apart from said clamping members and operable under compression to generate an output signal representative of the compressive load placed on said load cell, a force member for biasing the other of said clamping members towards said one clamping member and against said thread, said thread being squeezed between said clamping members and said one clamping member being forced against said load cell wherein to place a compressive force on said load cell, and adjusting means for increasing or decreasing the compressive force applied by said force member against said load cell.

According to an important aspect of this invention, the thread tensioning apparatus further comprises:

means for displaying the output signal from said load cell, wherein to provide the user with an indication of the amount of compression placed on the load cell, the compressive force being directly related to the amount of tension in the thread.

According to another aspect of this invention, the tension adjuster further comprises:

a comparator for receiving and comparing the output signal to a predetermined value representative of a desired thread tension, and providing a command signal to indicate that the clamping pressure against the thread and thus the tension in the thread is not in conformance with a desired tension.

In one illustrative embodiment according to this invention, a partially threaded mounting shaft projects from the housing of the sewing machine, a manipulator knob is connected to the distal end of the shaft, and the load cell, the clamping members, and the force member are centrally apertured and slidably arranged on the support shaft between the housing and the knob. Manual rotational adjustment and axial movement of the knob in a direction towards or away, respectively, from the load cell will increase or decrease the compressive grip on the thread and thus the tension in the thread passing between the source and the station. The compressive force on the load cell is increased or decreased, respectively, depending on the direction of movement of the clamping members.

According to this illustrative embodiment, the clamping members comprise circular discs and the force member comprises a helical coil spring.

Another illustrative embodiment of a thread tension adjusting apparatus for adjusting and monitoring the tension of a supplied thread in a sewing machine according to this invention comprises a partially threaded mounting shaft, which projects from the sewing machine, a pair of thread clamping members, a force member for compressing the clamping members, and a cylindrical spacer. The force member comprises a pneumatic actuator having an actuator body and an actuator rod fixedly connected to the distal end of the shaft and adapted to undergo reciprocating movement relative to the actuator body. The clamping members and the spacer are slidably disposed on the support shaft with the spacer being interposed between the actuator body and the clamping members.

Axial reciprocating movement of the actuator housing relative to the shaft will place the clamping members under increased or decreased compression, respectively, to increase or decrease the compressive grip of the clamping members on the thread and the tension in the thread passing between the source and the station. For example, because the actuator rod is fixed to the shaft end, actuation of the pneumatic actuator in a manner to cause the actuator rod to be retracted into the actuator housing will pull the actuator housing towards and against the spacer and force the spacer against the clamping members, whereby to increase the compression in the clamping members and the grip on the thread. Contrariwise, the actuator housing will be pushed away from the spacer whereby to decrease the compression in the clamping members.

Further and according to this invention, there is provided a tensioning device on a sewing machine for monitoring and adjusting the tension in a thread passed through the machine during a stitching operation, the tensioning device comprising:

a support shaft having proximal and distal ends, respectively, connected to and spaced from a support wall of the sewing machine, a ring shaped electromechanical load cell, the load cell being mounted on said shaft and disposed against said support wall, said load cell being operable to generate an output signal representative of the amount of compression placed thereon, a pair of centrally apertured discs, the discs being mounted on said shaft with one said disc being disposed against said load cell, the thread being routed between and engaged by the discs, an adjustment knob threadably connected to the distal end of said support shaft, a resilient helical coil spring disposed about said shaft, said spring having opposite end portions with one and the other of said end portions, respectively, engaging the other of said disc members and said adjustment knob, movement of said knob towards said support wall driving said spring and said disc members against the load cell and compressing said load cell, and means for receiving and displaying said output signal.

Advantageously, employing an apparatus according to the invention makes possible with a great degree of accuracy the monitoring of the thread tension in a sewing machine, and thereby enabling a "perfect stitch" to be achieved.

Further, the use of the monitoring and setting apparatus of the present invention may be easily installed on many machines currently in use with only minor changes in such machines.

Additionally, the simplicity of design enables rapid and accurate tension to be set as the user changes the type of thread material used.

Desirably, accurate, repeatable measurement and monitoring of the compression force placed on the thread clamping (i.e., squeezing) discs is provided.

Further, the apparatus herein enables the operator to determine conformance or nonconformance of thread tension for the purpose of enabling or disabling the sewing operation.

Further, a commercially available load cell may be used herewith.

BRIEF DESCRIPTION OF THE DRAWINGS

These and other objects, advantages and features of the invention will become apparent from the following description taken in conjunction with the accompanying drawings, which illustrate specific embodiments of the invention. In the drawings.

DETAILED DESCRIPTION OF THE PREFERRED EMBODIMENTS

Figure 1:
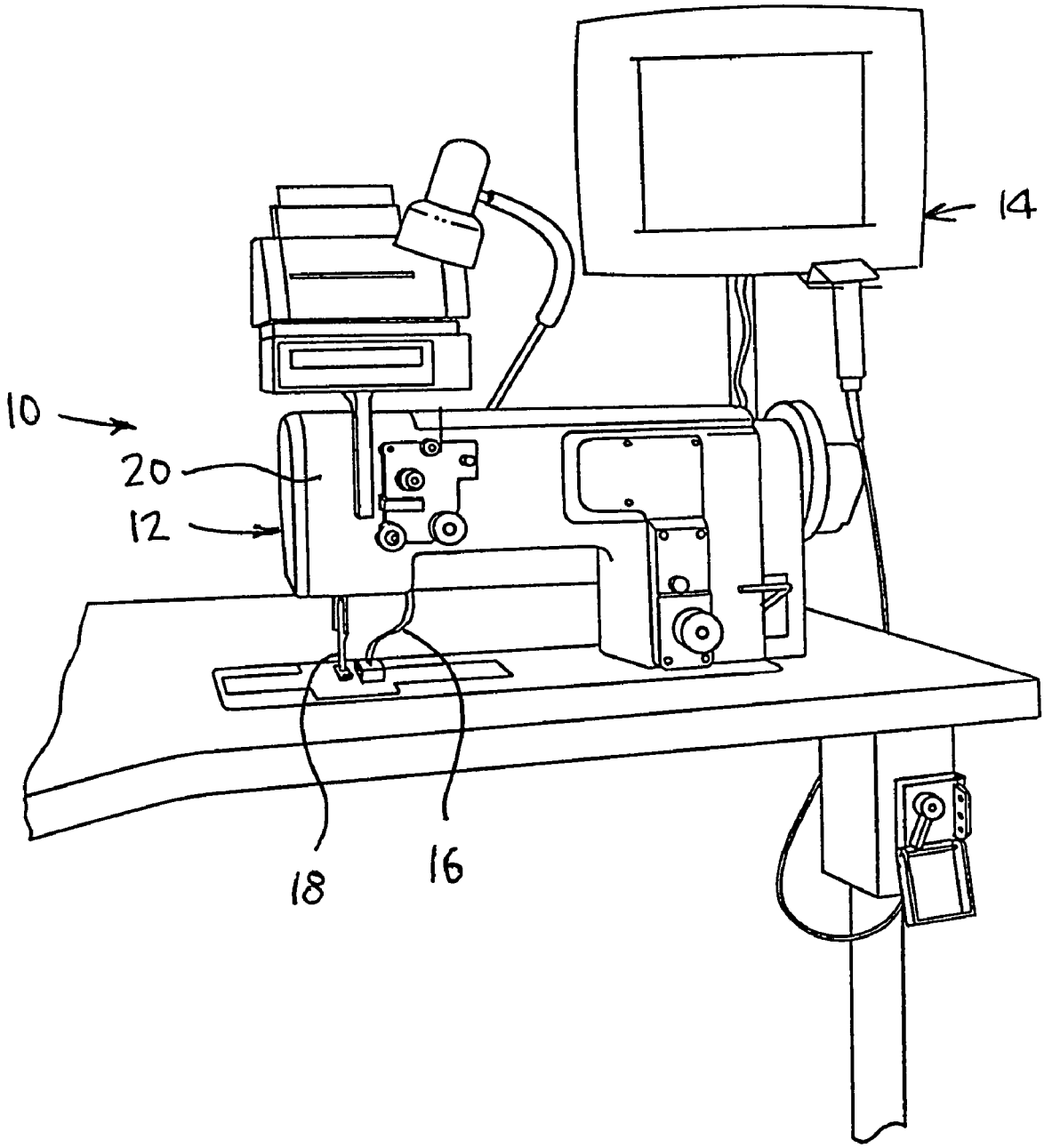
FIG. 1 is a perspective view of a sewing machine arrangement having a display unit associated therewith.

Referring to FIG. 1, a sewing system according to this invention is generally denoted by the number 10 and includes a sewing machine 12 operably connected to a display monitor 14 to provide the user with a readout of the tension in the sewing thread 16 during operation of the sewing needle 18. Additionally, the sewing machine assembly 10 includes an electronic control assembly (not shown) electrically connecting the output of a load cell (to be described herein below) to the monitor 14. It is to be noted that the integration of the display unit 14 for visually displaying the tension is ordinarily not associated with a conventional industrial sewing machine. However, to facilitate the full use and spectrum of the present invention optimally such a display unit is associated herewith.

The sewing machine 12 includes a shaped body or housing 20, which encloses an array of gears, cams, cranks and belts, and an electric motor to drive the machine parts. The exact configurations of these elements differs from machine to machine and are not described herein as being understood by one skilled in the sewing machine art. In general, the electric motor is connected to a drive wheel by way of a drive belt. The drive wheel rotates a drive shaft, which is in turn interconnected with several mechanical elements. The end of the drive shaft turns a crank, which pulls a needle bar, and thus the needle 18 up and down.

Sewing thread runs from a spool or source, through a thread tension disc assembly, and to the needle. By manipulating the disc assembly, the operator can tighten the thread feeding into the needle.

Figure 2:
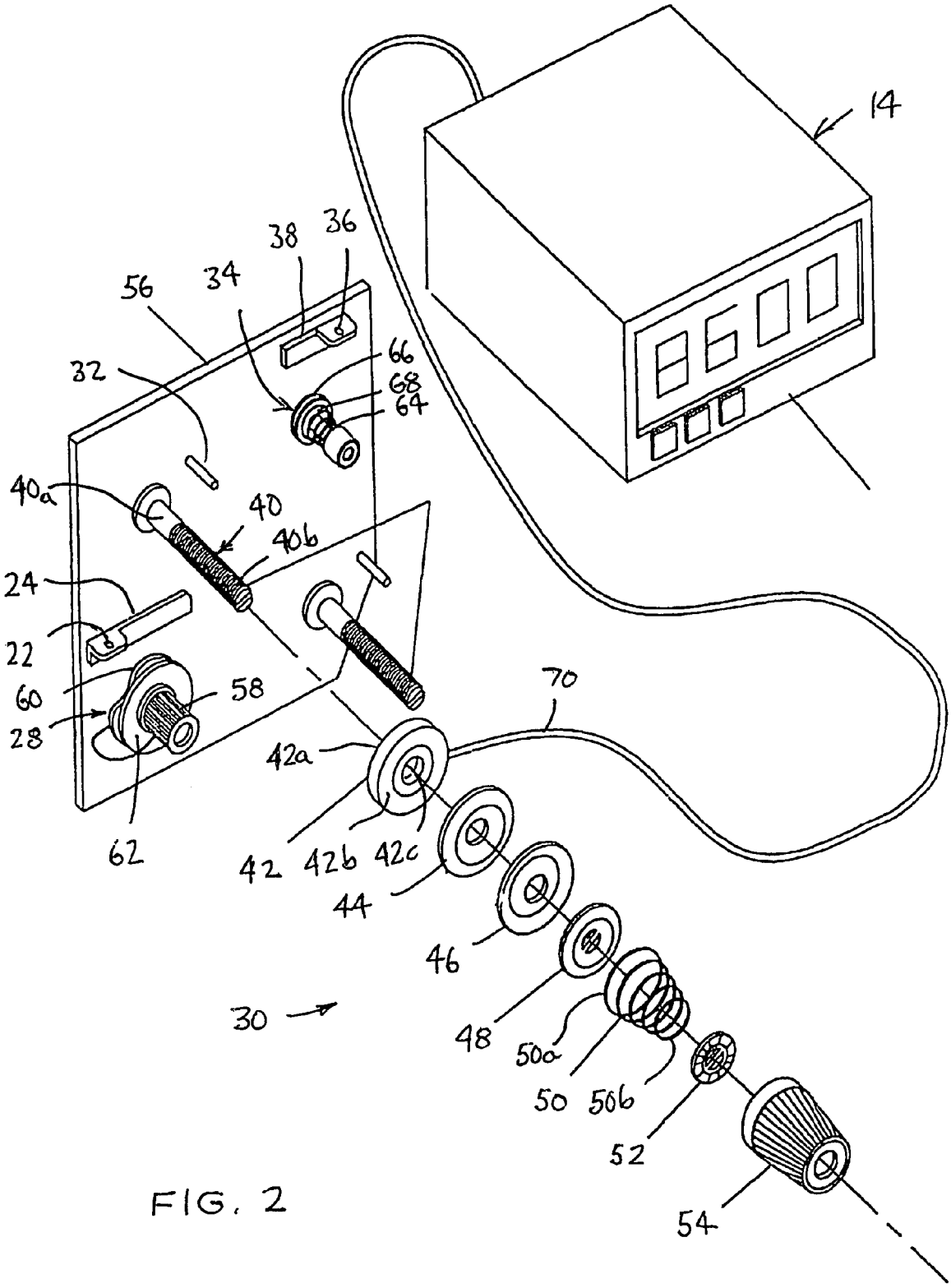
FIG. 2 is an exploded view of a thread tensioning apparatus according to the present invention used in the sewing machine of FIG. 1.
Figure 3:
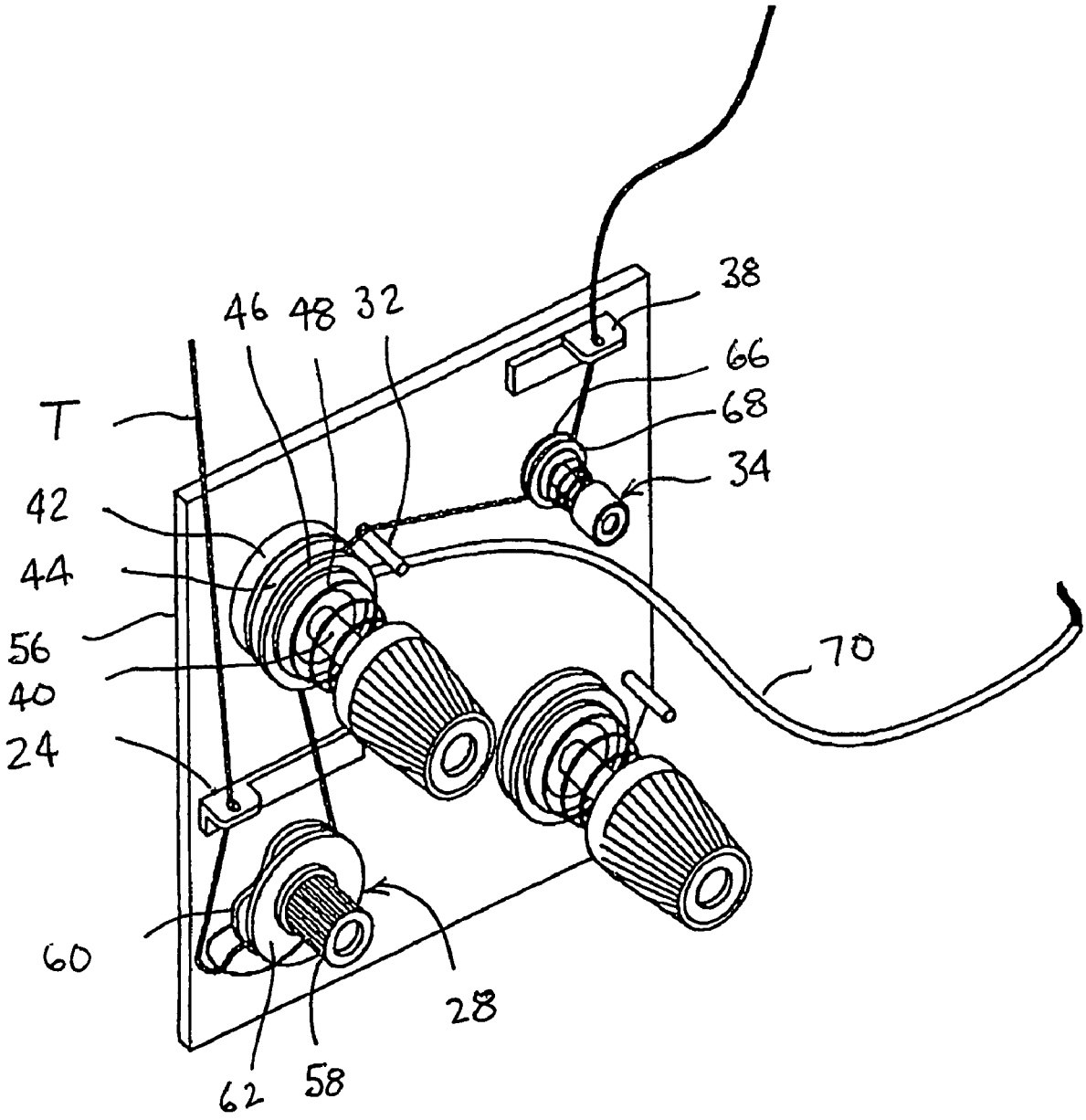
FIG. 3 is the thread tensioning apparatus of FIG. 2 when assembled.

FIGS. 2 and 3 illustrate a first embodiment of a thread tension force adjusting arrangement according to this invention. Sewing thread "T" is passed from the source (not shown) to the needle (not shown) whereby the thread is guided through an aperture 22 of a first guide arm 24, downwardly and around a first disc assembly 28, through a thread tensioning apparatus 30 according to this invention, about a guide pin 32, around a second disc assembly 34, and through an aperture 36 of a second guide arm 38.

The thread tensioning apparatus 30 includes an axial shaft 40, upon which are mounted a load cell 42, a pair of clamping members or discs 44 and 46, a releasing disc 48, a helical coil spring 50, a knob detent disc 52, and a manipulating knob 54. The shaft 40 has a proximal end 40*a* fixedly attached to a plate or portion 56 of the housing 20 and a distal end portion 40*b* spaced from the plate 56 and inwardly of the housing chamber. Preferably, the distal end portion 40*b* is partially threaded.

The first and second disc assemblies 28 and 34 are similar, differing primarily in dimension of the disc. The disc assembly 28 comprises a shaft 58 upon which are mounted a pair of generally circular, centrally apertured discs 60 and 62. The discs 60 and 62 are juxtaposed with one another, held in biased engagement with one another, and adapted to receive and pass the thread from the first guide arm 24, over the shaft 58, and to the thread tensioning apparatus 30. Preferably, the disc 60 is disposed against the plate 56 and has a convoluted surface to enable thread to pass.

Similarly, the disc assembly 34 comprises a shaft 64 upon which are mounted a pair of generally circular centrally apertured discs 66 and 68. The discs 66 and 68 are juxtaposed with one another, held in biased engagement with one another, and adapted to receive and pass the thread "T" from the thread tensioning apparatus 30, over the shaft 64, and to the second guide arm 38. The disc 66 is disposed against the plate 56.

Preferably and according to this invention, the load cell 42 is ring shaped, has generally planar faces 42*a* and 42*b*, and has a central opening 42*c* dimensioned to clearance fit about the diameter of the threaded shaft 40 and permit the load cell to be freely slidably positioned thereabout. In some applications, where fixation or positioning of the load cell relative to the sewing machine is desirable, the thread on the shaft 40 may extend to the plate 56 and the wall defining the central opening 42*c* may be provided with thread that is engageable with the shaft 40. So mounted on the shaft 40, the planar face 42*a* is adapted to be abutted against the plate 56.

The load cell 42 is provided with an electrical cable 70, which is connectible to the monitor 14 to provide an indication or output signal representative of the amount of compression force placed on the faces 42*a* and 42*b* of the load cell, and to receive power from the control assembly to power the load cell. The load cell is highly sensitive and can react even against an extremely slight change in pressure placed thereagainst to provide an output simultaneously with the compressive force placed thereagainst.

The ring shaped load cell 42 is compact and is commercially available in various designs, including strain gage, piezoresistive, inductive and reluctance, and magnetoresistive, to name a few. Strain gage load cells are attractive in that they are low in cost, offer accuracies from within 0.035 to about 0.25% full scale, and are compatible with digital, computer-based instrumentation. Similar in operation to the strain gage, the piezoresistive load cell generates a high-level output signal and can be readily connected directly to a readout meter.

The clamping members or discs 44 and 46 are generally circular, centrally apertured, and mounted onto the shaft 40 so as to be juxtaposed with one another. The central apertures of the discs 44 and 46 are dimensioned to enable slidable positioning along the shaft. So mounted and positioned, the disc 44 is adapted to be abutted against the planar face 42*b* of the load cell 42 and the disc 46 is abutted against the tension releasing disc 48. In cross-section, the discs 44, 46, and 48 have smooth concave and convex surface portions.

The spring 50 comprises a helical coil of generally frusto-conical shape that has opposite ends 50*a* and 50*b*. The larger end 50*a* is adapted to engage the tension-releasing disc 48 and the smaller end 50*b* is adapted to engage the knob detent disc 52.

The manipulating knob 54 is adapted to be secured to the distal end 40*b* of the shaft 40 and engage the knob detent disc 52. So secured, the knob 54 is adapted, upon rotation in a clockwise or a counterclockwise direction, to advance inwardly or outwardly relative to the shaft. The sense of the thread determines the inward or outward advance of the knob.

In operation, manipulation (e.g., clockwise rotation) of the knob 54 on the proximal end 40*b* of the threaded shaft 40 advances the knob axially inwardly, forcing the disc 48 against the spring 50 and the spring against the clamping discs 44 and 46. Substantially simultaneously, the clamping discs 44 and 46 are "squeezed" against the thread and forced against the load cell 42. This results in the tension in the thread being pulled through the discs 44 and 46 being increased and the load cell 42 being placed under an increased compression. The "compressed" load cell 42 will then generate an output signal $S_1$ that is proportional to the amount of compression force applied by the coil spring (i.e., reflective of the increased tension placed on the thread).

Importantly, the electronic control assembly electrically connecting the output of a load cell 42 to the monitor 14 includes electrical circuitry to process the output signal $S_1$, and electrical circuitry to amplify and/or mathematically scale the output signal into a signal $S_2$ that is suitable for comparative calculations. This signal $S_2$ may be then fed into the monitor to provide a visual display corresponding to the value of the processed output signal produced by the load cell. The circuitry itself is not shown as being understood by one skilled in the art.

The signal $S_2$ may also be fed into a comparator 15, which comparator has been fed a present value $T_1$, representative of the desired tension in the thread. The processed signal $S_2$ fed into the comparison circuit is compared with the preset level $T_1$ and when the signal $S_2$ differs (e.g., exceeds the tension) the preset level, the comparison circuit outputs an alert signal. The thread tensioning assembly described provides the user with accurate, repeatable measurement and monitoring of the varying compression force applied to the thread tensioning discs 44 and 46 and provides a visual display corresponding to the actual amount of force being actually applied.

The assembly according to this embodiment of the invention provides the operator with a method of control to allow or disallow normal operation of a sewing machine, based on electronic comparison of the electrical signal produced by the load cell to established reference values. The comparison being performed by the electronic control, and a corresponding electrical output being provided by the electronic control to be used for the purpose of controlling, enabling, or disabling of the sewing machine operation, or for the purpose of indicating a non-conformance of the load cell signal value to the pre-established reference values.

Figure 4:
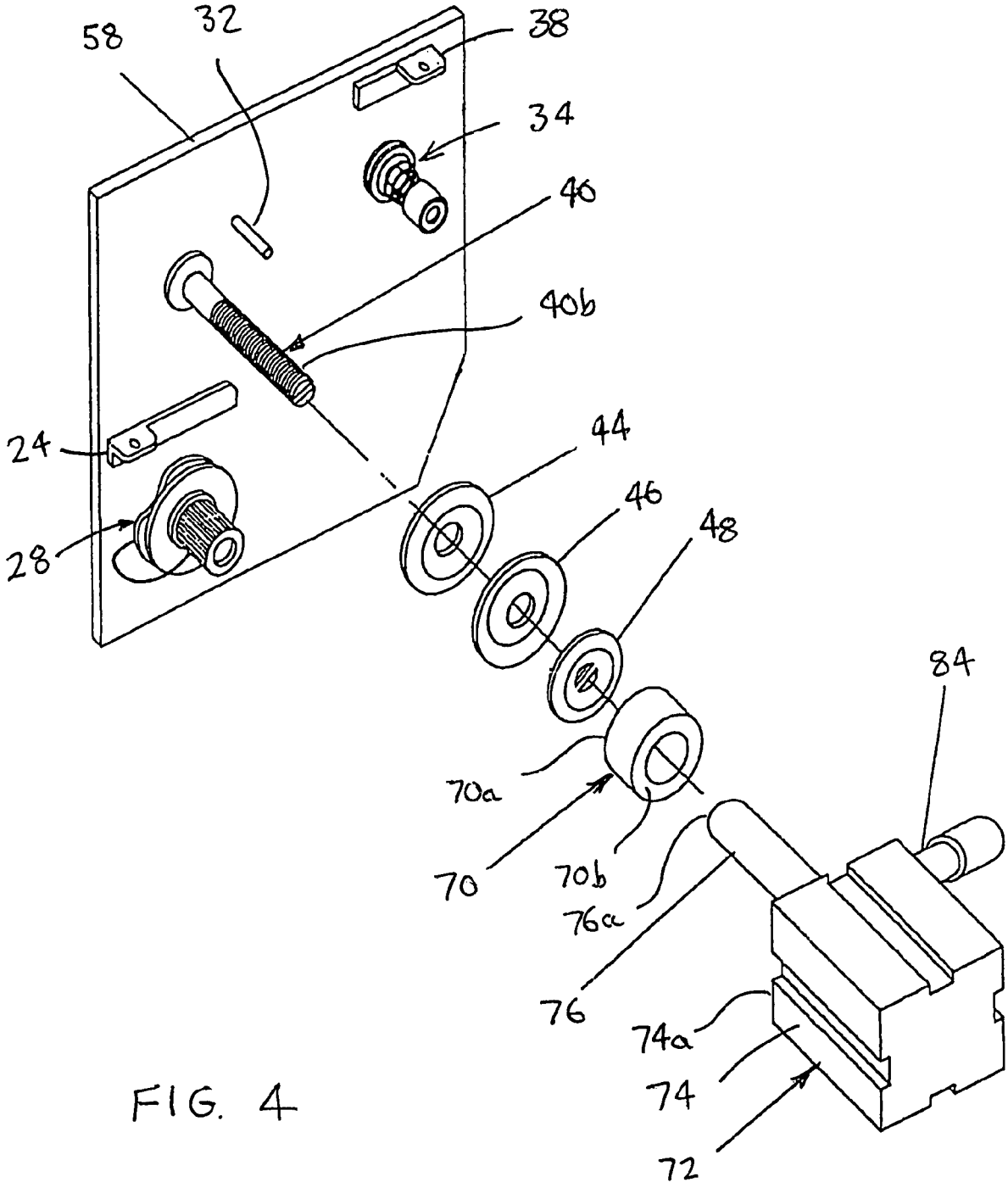
FIG. 4 is an exploded view of another thread tensioning apparatus according to the present invention used in the sewing machine of FIG. 1.
Figure 5:
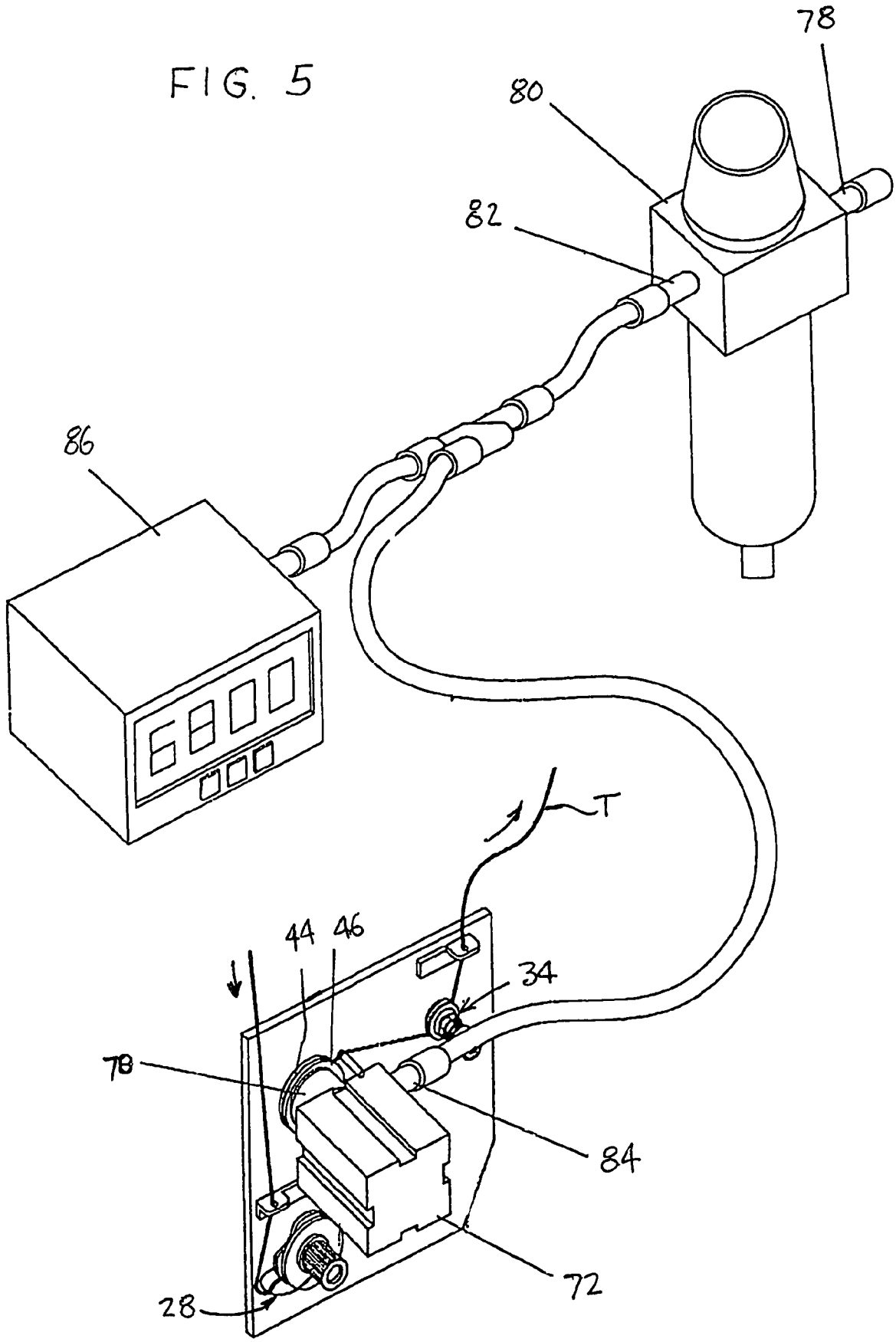
FIG. 5 is the thread tensioning apparatus of FIG. 4 when assembled.

FIGS. 4 and 5 illustrate a second embodiment of a thread tension force adjusting arrangement according to this invention. The arrangement is similar to that shown in FIGS. 2 and 3, except that the load cell 42, the spring 50, the knob detent disc 52, and manipulation knob 54 are replaced with a spacer cylinder 70 and a pneumatic actuator 72. The clamping discs 44 and 46 are abutted against the plate 56, and the tension-releasing disc 48 is disposed against the clamping disc 46.

The spacer 70 is generally cylindrical and has opposite end faces 70*a* and 70*b*. The spacer 70 is mounted onto the shaft 40 and positioned so that the end face 70*a* is juxtaposed against the tension-releasing disc 48.

The pneumatic actuator 72 includes an actuator body 74 having an abutment face 74*a* and an actuator rod 76 mounted for axial reciprocating movement relative to the actuator body 74. The forward end 76*a* of the rod is provided with an internally threaded bore, which is adapted to engage with the threaded end portion 40*b* of the shaft 40. So mounted, the forward end 74*a* is abutted against the end face 70*b* of the spacer.

In operation, pressure in the pneumatic actuator 72 is changed in such a manner as to cause the actuator rod 76 to retract into the actuator body 74, causing the body 74 to be pulled against the spacer 70 with a force proportional to the amount of pneumatic pressure applied to the pneumatic actuator 72. As the pressure is applied, a compressive force is transmitted to the spacer 70, the tension releasing disc 48, and the thread clamping discs 44 and 46.

As shown in FIG. 5, pneumatic pressure to the pneumatic actuator 72 is supplied by connecting a compressed air source 78 to the pneumatic pressure regulator 80, and connecting the output of the pressure regulated compressed gas 82 from the regulator 80 to the air input port 84 of the pneumatic actuator 72. Manipulation of the pressure adjustment mechanism at the pressure regulator 80 produces a variation in the pneumatic pressure applied to the pneumatic actuator 72, and corresponding variation of the amount of compressive force applied to the thread clamping (i.e., tensioning) discs 44 and 46.

A pneumatic pressure sensing device 86 is connected to the source of compressed air that is supplied to the pneumatic actuator 72. According to this embodiment of the invention, the sensing device 86 includes electronic circuitry to convert the pneumatic pressure value of the connected air source to an electrical signal, circuitry to compare the converted signal to reference values, circuitry to provide an electrical output which corresponds to the conformance or nonconformance of the converted signal to established reference values, and circuitry to provide a visual display of the actual pneumatic pressure being applied to the sensing device. The circuitry is not shown as being known by those skilled in the art.

As the pneumatic pressure sensing device 86 is connected to the same source of pressure regulated compressed air that is supplied to the pneumatic actuator, and the actuator 72 is applying the required compressive force to the thread tensioning discs 44 and 46, the visual display and electrical output produced by the sensing device 86 can be utilized as an accurate, repeatable method of controlling and monitoring the amount of thread tensioning force applied to the thread tensioning discs 44 and 46.

The invention claimed is:

1. A thread tensioning apparatus for adjusting and monitoring the tension in a thread passing through a sewing machine during a stitching operation, comprising:

a pair of clamping members movably mounted in juxtaposition with one another, the clamping members being movable towards one another and into clamping relation with the thread passing therebetween during the stitching operation, an electromechanical compression load cell disposed in contacting relation against one of said clamping members, said load cell being separate and apart from said clamping members and operable under compression to generate an output signal representative of the compressive load placed on said load cell and the tension in said thread, a comparator for receiving and comparing the output signal to a predetermined value representative of a desired thread tension and providing a command signal to indicate that the clamping pressure against the thread and thus the tension in the thread is not in conformance with the desired tension, a force member for biasing the other of said clamping members towards said one clamping member and against said thread, said thread being squeezed between said clamping members and said one clamping member being forced against said load cell wherein to place a compressive force on said load cell, a manually operated adjustment knob, said knob being abutted against said force member and mounted for movement towards and away from said load cell for increasing or decreasing the compressive force applied by said force member against said load cell, and wherein when the comparator generates a command signal that the tension in the thread is not in conformance with the desired tension, the adjustment knob is moved towards or away from the load cell to increase or decrease the compressive force of the clamping members on the thread to adjust the tension in the thread as needed.

2. A thread tension adjusting apparatus for adjusting and monitoring the tension of a supplied thread in a sewing machine, comprising:

a partially threaded mounting shaft, which projects from the sewing machine, a pair of thread clamping members slidably disposed in juxtaposed relation on said shaft, one clamping member being juxtaposed against the sewing machine, a cylindrical spacer slidably disposed on said shaft in being juxtaposed against the other clamping member, and a force member for compressing the clamping members, said force member comprising a pneumatically controlled actuator having an actuator rod fixedly connected to the distal end of said shaft and an actuator body, said actuator rod being adapted to undergo axial reciprocating movement relative to the actuator body with axial reciprocating movement of the actuator shaft moving the actuator body towards and away from the thread clamping members and placing the clamping members under increased or decreased compression, respectively, to increase or decrease the compressive grip of the clamping members on the thread and the tension in the thread passing between the thread clamping members.

3. A thread tension adjusting apparatus for adjusting and monitoring the tension of a supplied thread in a sewing machine, comprising:

a partially threaded mounting shaft, which projects from the sewing machine, a spacer fixedly connected to the distal end of said shaft, a pair of thread clamping members slidably disposed in juxtaposed relation on said shaft and interposed between said spacer and said sewing machine, and a force member adapted to undergo axial reciprocating movement relative to the spacer and said sewing machine with axial reciprocating movement moving the force member into and away from engagement with the thread clamping members and placing a thread passing between the clamping members under increased or decreased compression, wherein said force member comprises a pneumatically controlled actuator, said actuator including an actuator body connectible to a compressed air source, and said spacer comprises an actuator rod adapted to undergo axial reciprocating movement relative to the actuator body with axial reciprocating movement of the actuator rod moving the actuator body towards and away from the thread clamping members and the clamping members towards and away from engagement with the sewing machine, the reciprocating movement placing the clamping members under increased or decreased compression, respectively, to increase or decrease the compressive grip of the clamping members on the thread and the tension in the thread passing between the thread clamping members.

4. A tensioning device for a sewing machine for monitoring and adjusting the tension in a thread passed through the machine during a stitching operation, which comprises:

a support shaft having proximal and distal ends, respectively, connected to and spaced from a support wall of the sewing machine, a ring shaped electromechanical load cell, the load cell being mounted on said shaft and disposed next to said support wall, a pair of centrally apertured disc members, the discs being mounted on said shaft with one said disc being disposed against said load cell, the thread being routed between and engaged by the discs, an adjustment knob threadably connected to the distal end of said support shaft, a resilient helical coil spring disposed about said shaft, said spring having opposite end portions with one and the other of said end portions, respectively, engaging the other of said disc members and said adjustment knob, movement of said knob towards said support wall driving said spring and said disc members against the load cell and compressing said load cell, said load cell, when compressed, being operable to generate an output signal representative of the amount of tension placed on the thread, and means for receiving and displaying said output signal.

5. The apparatus of claim 1, further comprising means for displaying the output signal from said load cell, the means for displaying providing the user with an indication of the amount of compression placed on the load cell, the compressive force being directly related to the amount of tension in the thread.

6. The apparatus of claim 2, further comprising:

a mounting shaft projecting from the housing, the shaft having a proximal and distal a end, and a manipulator knob connected to the distal end of the shaft, and wherein the load cell, clamping members, and force member each have a central aperture for slidably mounting each on the support shaft between the housing and the knob.

7. The apparatus of claim 6 wherein the clamping members each comprise a circular disc, and the force member comprises a helical coil spring.

8. The thread tensioning apparatus of claim 3, further comprising:

a pneumatic pressure sensing device, said pressure sensing device being connectible to the pressure source and said pneumatically controlled actuator and including means for regulating the pressure of the compressed air supplied to the pneumatically controlled actuator, electronic circuitry, said circuitry for converting the pneumatic pressure value of the connected air source to an electrical signal, comparing the converted signal to reference values, and providing an electrical output which corresponds to the conformance or nonconformance of the electrical signal to established reference values, and means for monitoring and displaying the actual pneumatic pressure being supplied to the pneumatic sensing device.

* * * * *